US007994446B2

(12) United States Patent
Chao

(10) Patent No.: US 7,994,446 B2
(45) Date of Patent: Aug. 9, 2011

(54) KEY MECHANISMS

(75) Inventor: Ling-Hsi Chao, Taoyuan County (TW)

(73) Assignee: Darfon Electronics Corp., Taoyuan (TW)

( * ) Notice: Subject to any disclaimer, the term of this patent is extended or adjusted under 35 U.S.C. 154(b) by 303 days.

(21) Appl. No.: 12/143,073

(22) Filed: Jun. 20, 2008

(65) Prior Publication Data

US 2008/0314101 A1 Dec. 25, 2008

(30) Foreign Application Priority Data

Jun. 20, 2007 (TW) ..... 96210003 U

(51) Int. Cl.
*H01H 13/70* (2006.01)

(52) U.S. Cl. ..... 200/344

(58) Field of Classification Search ..... 200/344
See application file for complete search history.

(56) References Cited

U.S. PATENT DOCUMENTS 4,468,145 A * 8/1984 Denley ..... 400/496
5,350,244 A * 9/1994 Buttner ..... 400/496
6,002,092 A * 12/1999 Pan ..... 200/344
6,624,369 B2 * 9/2003 Ito et al. ..... 200/344
6,689,977 B2 * 2/2004 Ito et al. ..... 200/344
7,173,200 B2 * 2/2007 Yoneyama ..... 200/5 A
7,183,512 B2 * 2/2007 Lee et al. ..... 200/344
7,332,687 B2 * 2/2008 Liu ..... 200/344

* cited by examiner

*Primary Examiner* — Renee S Luebke
*Assistant Examiner* — Lisa Klaus

(57) ABSTRACT

A key mechanism. A base plate includes at least one first guiding base, at least one second guiding base, at least one first barricade, and at least one second barricade. The first guiding base opposes the second guiding base. The first barricade opposes the second barricade. A scissors linking assembly is connected to the base plate and includes a first linking member and a second linking member. The first linking member pivots to the second linking member and includes a first guiding pillar. The second linking member includes a second guiding pillar. The first guiding pillar is disposed in the first guiding base through the first barricade and is abutted therebetween. The second guiding pillar is disposed in the second guiding base through the second barricade and is abutted therebetween. A keycap is connected to the scissors linking assembly.

6 Claims, 11 Drawing Sheets

KEY MECHANISMS

CROSS REFERENCE TO RELATED APPLICATIONS

This Application claims priority of Taiwan Patent Application No. 96210003, filed on Jun. 20, 2007, the entirety of which is incorporated by reference herein.

BACKGROUND OF THE INVENTION

1. Field of the Invention

The invention relates to key mechanisms, and in particular to key mechanisms that can be assembled in a rapid and convenient manner.

2. Description of the Related Art

Referring to FIG. 1, a conventional key mechanism 1 comprises a base plate 10, a scissors linking assembly 20, and a keycap 30. The base plate 10 comprises two pivot bases 11 and two guiding bases 12. Here, FIG. 1 shows only a pivot base 11 and a guiding base 12. The scissors linking assembly 20 comprises a first linking member 21 and a second linking member 22 pivoting thereto. The first linking member 21 comprises two first guiding pillars 21*a* respectively pivoting to the pivot bases 11 of the base plate 10. The second linking member 22 comprises two second guiding pillars 22*a*. The second guiding pillars 22*a* are slidably disposed in the guiding bases 12 of the base plate 10, respectively. The keycap 30 is disposed on the scissors linking assembly 20.

Regarding assembly between the scissors linking assembly 20 and the keycap 30, the second guiding pillars 22*a* of the second linking member 22 are first disposed in the guiding bases 12. The first guiding pillars 21 a of the first linking member 21 then pivot to the pivot bases 11. Accordingly, two steps are required for the assembly between the scissors linking assembly 20 and the keycap 30, thereby causing inconvenience for assembling the overall key mechanism 1.

Hence, there is a need for key mechanisms with enhanced facilitation of assembly.

BRIEF SUMMARY OF THE INVENTION

A detailed description is given in the following embodiments with reference to the accompanying drawings.

An exemplary embodiment of the invention provides a key mechanism comprising a base plate, a scissors linking assembly, and a keycap. The base plate comprises at least one first guiding base, at least one second guiding base, at least one first barricade, and at least one second barricade. The first guiding base opposes the second guiding base. The first barricade opposes the second barricade. The scissors linking assembly is connected to the base plate and comprises a first linking member and a second linking member. The first linking member pivots to the second linking member and comprises a first guiding pillar. The second linking member comprises a second guiding pillar. The first guiding pillar is disposed in the first guiding base through the first barricade and is abutted between the first guiding base and the first barricade. The second guiding pillar is disposed in the second guiding base through the second barricade and is abutted between the second guiding base and the second barricade. The keycap is connected to the scissors linking assembly.

The first guiding pillar is rotatably abutted between the first guiding base and the first barricade.

The second guiding pillar is movably abutted between the second guiding base and the second barricade.

The first barricade comprises a first guiding slope through which the first guiding pillar is disposed in the first guiding base.

The second barricade comprises a second guiding slope through which the second guiding pillar is disposed in the second guiding base.

The first guiding pillar is disposed in the first guiding base by pushing of the first barricade.

The second guiding pillar is disposed in the second guiding base by pushing of the second barricade.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

First Embodiment

Figure 1:
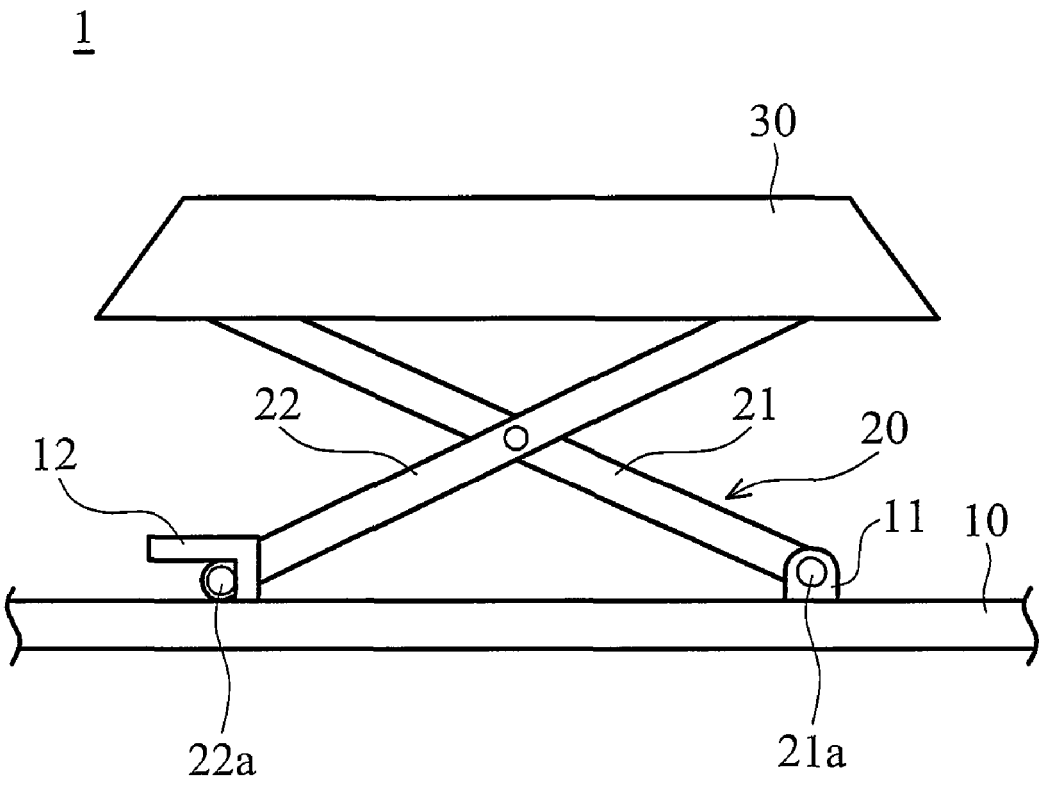
FIG. 1 ( PRIOR ART )
FIG. 1 is a schematic side view of a conventional key mechanism.
Figure 2A:
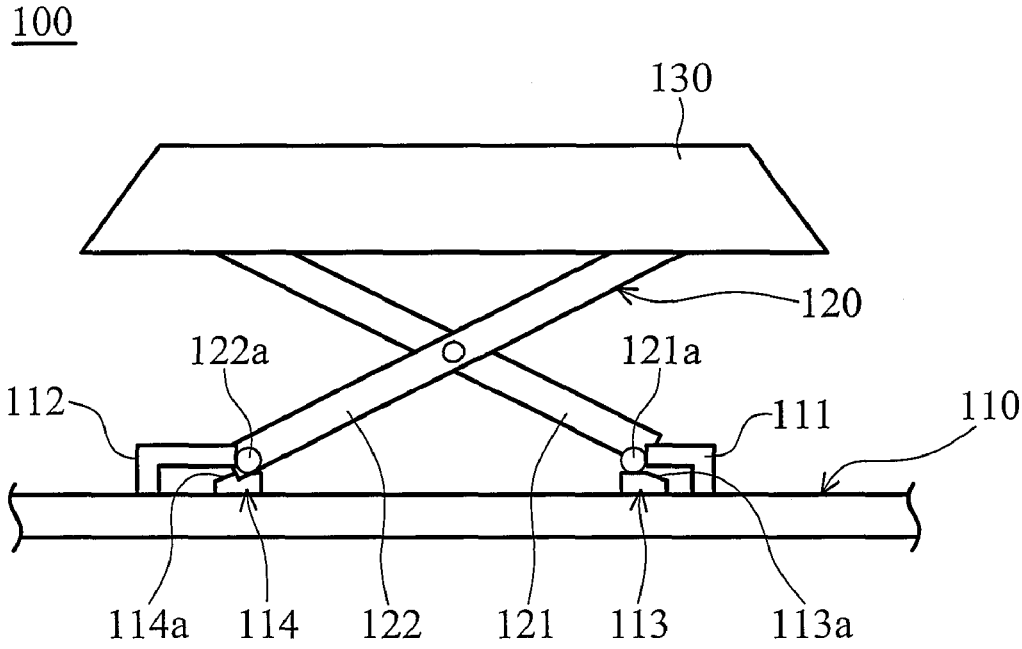
FIG. 2A is a schematic assembly view of a key mechanism of a first embodiment of the invention.
Figure 2B:
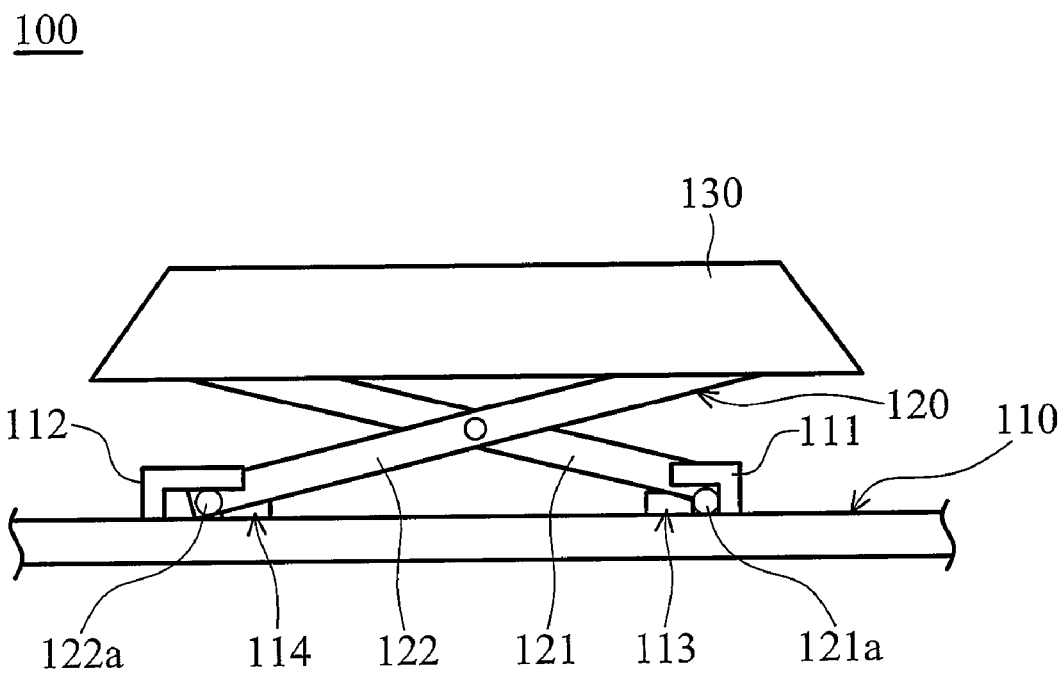
FIG. 2B is another schematic assembly view of the key mechanism of the first embodiment of the invention.

Referring to FIG. 2A and FIG. 2B, a key mechanism 100 comprises a base plate 110, a scissors linking assembly 120, and a keycap 130.

The keycap 130 is connected to the scissors linking assembly 120.

Figure 3A:
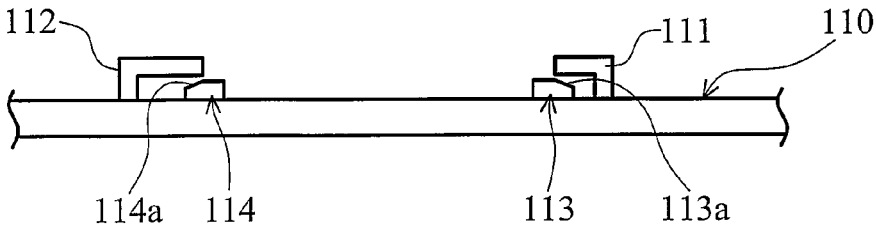
FIG. 3A is a schematic side view of a base plate of the key mechanism of the first embodiment of the invention.
Figure 3B:
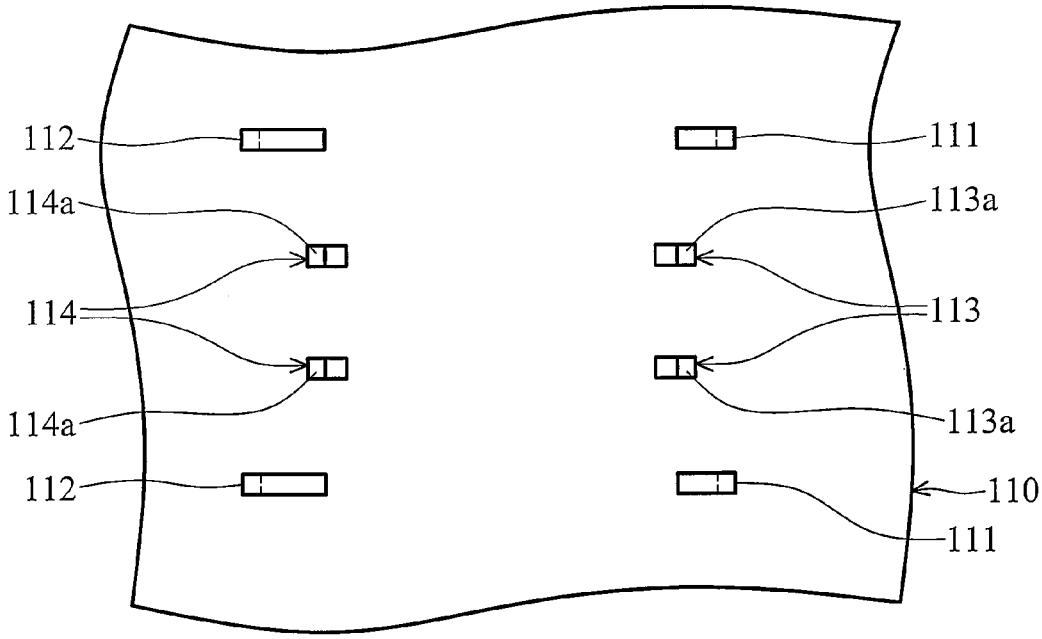
FIG. 3B is a schematic top view of the base plate of the key mechanism of the first embodiment of the invention.
Figure 3C:
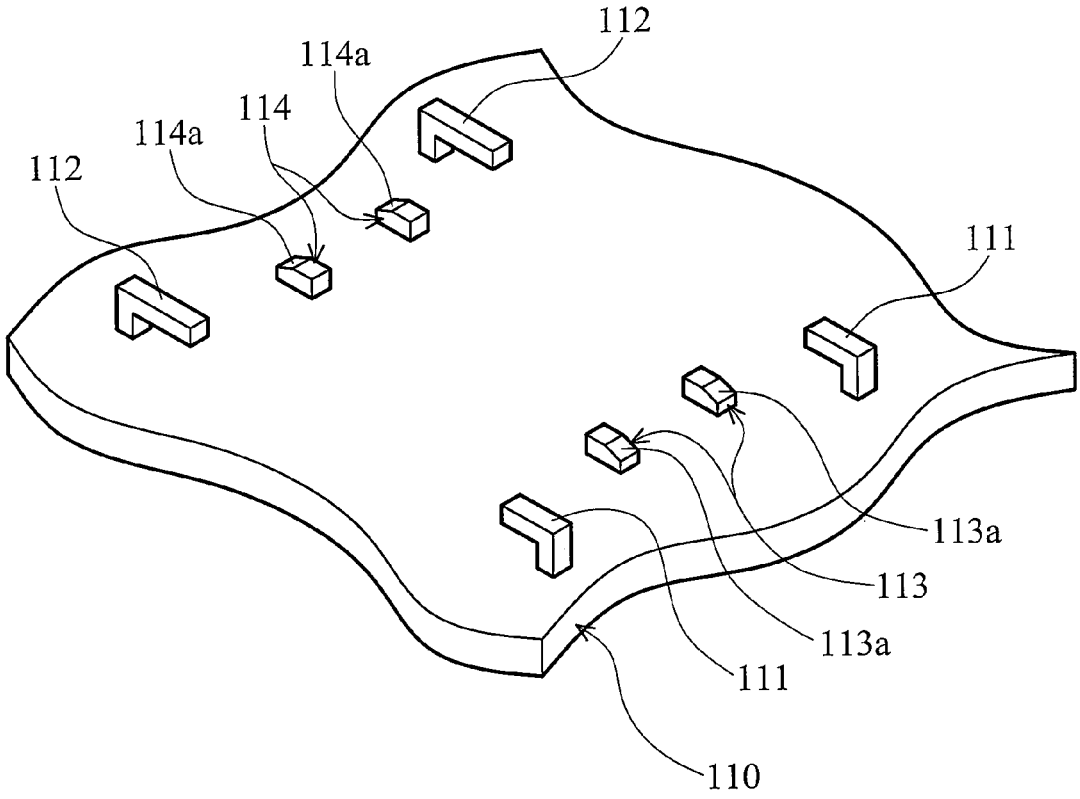
FIG. 3C is a schematic perspective view of the base plate of the key mechanism of the first embodiment of the invention.

Referring to FIGS. 3A, 3B, and 3C, the base plate 110 comprises two first guiding bases 111, two second guiding bases 112, two first barricades 113, and two second barricades 114. The first guiding bases 111 oppose the second guiding bases 112. The first barricades 113 oppose the second barricades 114. Each first barricade 113 comprises a first guiding slope 113*a*. Each second barricade 114 comprises a second guiding slope 114*a*. Moreover, the first barricades 113 are disposed between the first guiding bases 111, and the second barricades 114 are disposed between the second guiding bases 112.

As shown in FIG. 2A and FIG. 2B, the scissors linking assembly 120 is connected to the base plate 110 and comprises a first linking member 121 and a second linking member 122. The first linking member 121 pivots to the second linking member 122 and comprises a first guiding pillar 121*a*. The second linking member 122 comprises a second guiding pillar 122*a*. The first guiding pillar 121*a* is disposed in the first guiding bases 111 through the first guiding slopes 113*a* of the first barricades 113 and is rotatably abutted between the first guiding bases 111 and the first barricades 113. The second guiding pillar 122*a* is disposed in the second guiding bases 112 through the second guiding slopes 114*a* of the second barricades 114 and is movably abutted between the second guiding bases 112 and the second barricades 114.

During assembly between the scissors linking assembly 120 and the base plate 110, as shown in FIG. 2A, the scissors linking assembly 120 is first placed on the base plate 110. Here, the first guiding pillar 121*a* of the first linking member 121 is placed on the first barricades 113 and abuts outer edges of the first guiding bases 111, and the second guiding pillar 122*a* of the second linking member 122 is placed on the second barricades 114 and abuts outer edges of the second guiding bases 112. Then, the scissors linking assembly 120 is directly pressed toward the base plate 110. Here, the first guiding pillar 121*a* is elastically deformed by pushing of the first guiding slopes 113*a* of the first barricades 113, and the second guiding pillar 122*a* is elastically deformed by pushing of the second guiding slopes 114*a* of the second barricades 114. When no longer pushed by the first barricades 113, the first guiding pillar 121*a* is positioned in the first guiding bases 111. Similarly, when no longer pushed by the second barricades 114, the second guiding pillar 122*a* is positioned in the second guiding bases 112. Namely, the first guiding pillar 121*a* is disposed in the first guiding bases 111 by pushing of the first barricades 113, and the second guiding pillar 122*a* is disposed in the second guiding bases 112 by pushing of the second barricades 114. Accordingly, the assembly between the scissors linking assembly 120 and the base plate 110 is complete, as shown in FIG. 2B.

Moreover, the key mechanism 100 is not limited to having two first barricades 113 and two second barricades 114. Namely, the key mechanism 100 may have only a first barricade 113 and a second barricade 114, achieving the same effect as described above.

Second Embodiment

Elements corresponding to those in the first embodiment share the same reference numerals.

Figure 4A:
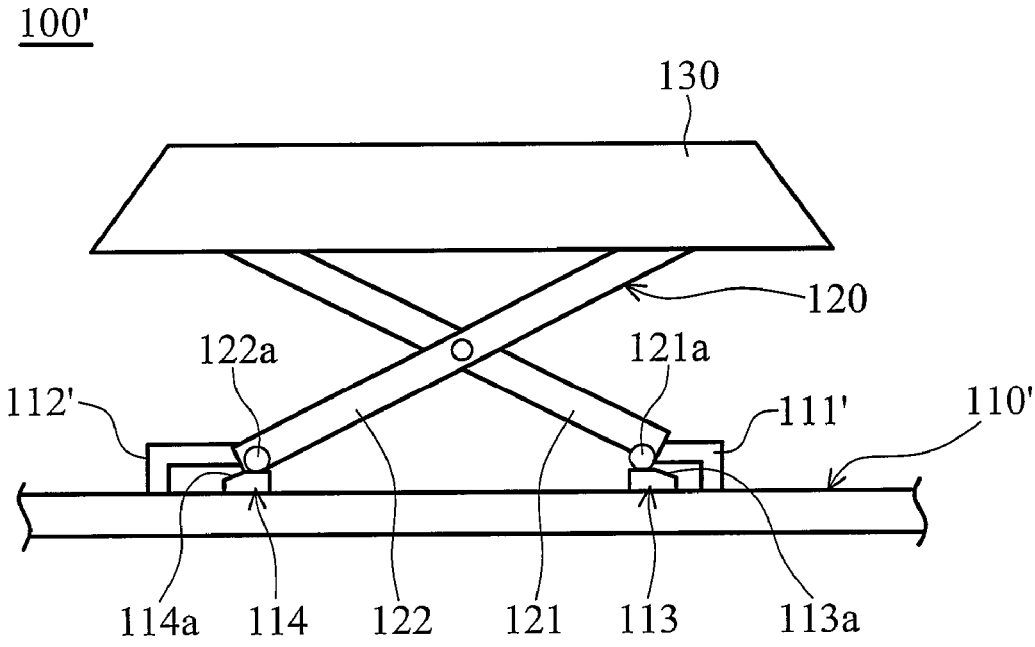
FIG. 4A is a schematic assembly view of a key mechanism of a second embodiment of the invention.
Figure 4B:
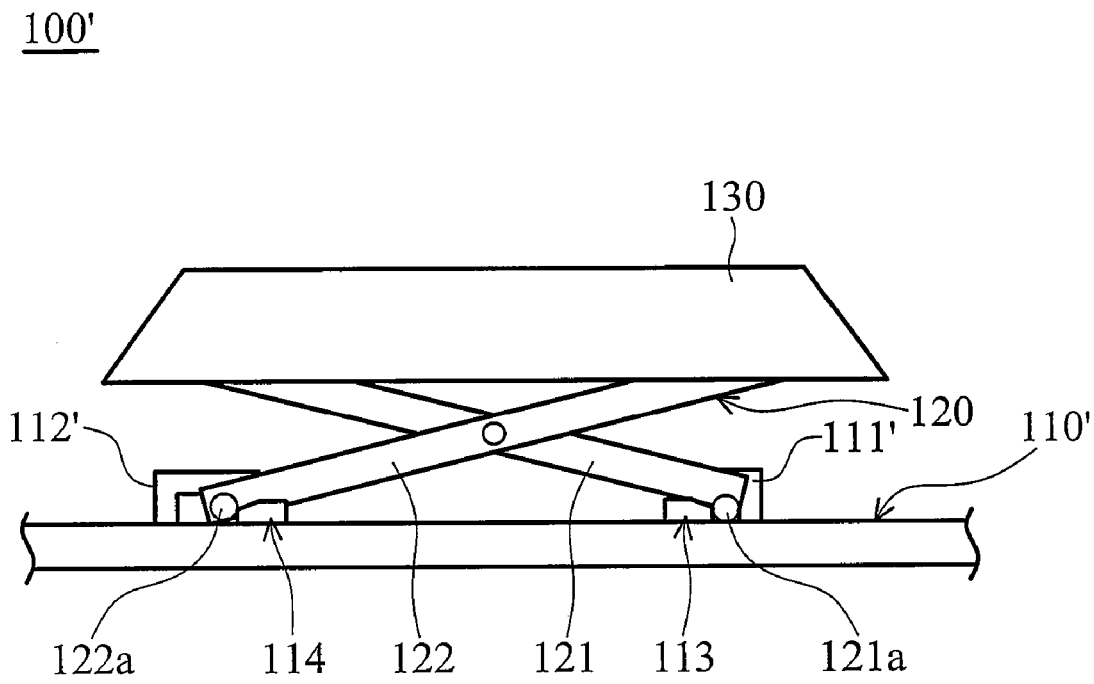
FIG. 4B is another schematic assembly view of the key mechanism of the second embodiment of the invention.

Referring to FIG. 4A and FIG. 4B, a key mechanism 100' comprises a base plate 110', a scissors linking assembly 120, and a keycap 130.

The keycap 130 is connected to the scissors linking assembly 120.

Figure 5A:
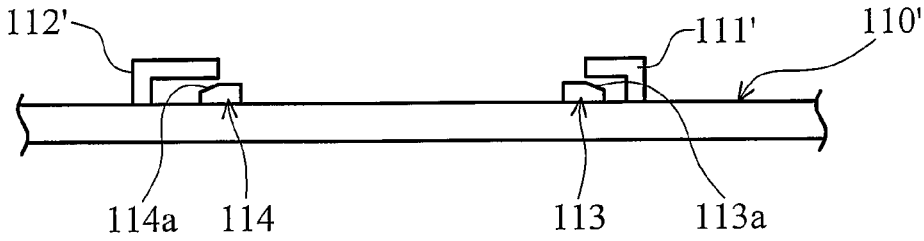
FIG. 5A is a schematic side view of a base plate of the key mechanism of the second embodiment of the invention.
Figure 5B:
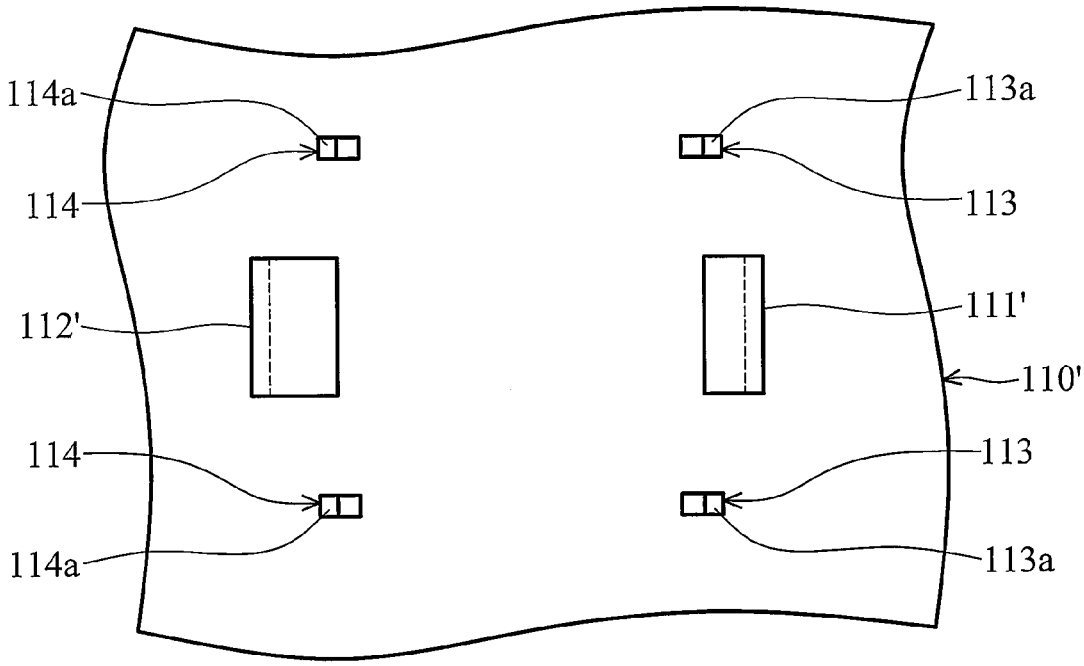
FIG. 5B is a schematic top view of the base plate of the key mechanism of the second embodiment of the invention.

Referring to FIG. 5A and FIG. 5B, the base plate 110' comprises a first guiding base 111', a second guiding base 112', two first barricades 113, and two second barricades 114. The first guiding base 111' opposes the second guiding base 112'. The first barricades 113 oppose the second barricades 114. Each first barricade 113 comprises a first guiding slope 113*a*. Each second barricade 114 comprises a second guiding slope 114*a*. Moreover, the first guiding base 111' is disposed between the first barricades 113, and the second guiding base 112' is disposed between the second barricades 114.

As shown in FIG. 4A and FIG. 4B, the scissors linking assembly 120 is connected to the base plate 110' and comprises a first linking member 121 and a second linking member 122. The first linking member 121 pivots to the second linking member 122 and comprises a first guiding pillar 121*a*. The second linking member 122 comprises a second guiding pillar 122*a*. The first guiding pillar 121*a* is disposed in the first guiding base 111' through the first guiding slopes 113*a* of the first barricades 113 and is rotatably abutted between the first guiding base 111' and the first barricades 113. The second guiding pillar 122*a* is disposed in the second guiding base 112' through the second guiding slopes 114*a* of the second barricades 114 and is movably abutted between the second guiding base 112' and the second barricades 114.

During assembly between the scissors linking assembly 120 and the base plate 110', as shown in FIG. 4A, the scissors linking assembly 120 is first placed on the base plate 110'. Here, the first guiding pillar 121*a* of the first linking member 121 is placed on the first barricades 113 and abuts an outer edge of the first guiding base 111', and the second guiding pillar 122*a* of the second linking member 122 is placed on the second barricades 114 and abuts an outer edge of the second guiding base 112'. Then, the scissors linking assembly 120 is directly pressed toward the base plate 110'. Here, the first guiding pillar 121*a* is elastically deformed by pushing of the first guiding slopes 113*a* of the first barricades 113, and the second guiding pillar 122*a* is elastically deformed by pushing of the second guiding slopes 114*a* of the second barricades 114. When no longer pushed by the first barricades 113, the first guiding pillar 121*a* is positioned in the first guiding base 111'. Similarly, when no longer pushed by the second barricades 114, the second guiding pillar 122*a* is positioned in the second guiding base 112'. Namely, the first guiding pillar 121*a* is disposed in the first guiding base 111' by pushing of the first barricades 113, and the second guiding pillar 122*a* is disposed in the second guiding base 112' by pushing of the second barricades 114. Accordingly, the assembly between the scissors linking assembly 120 and the base plate 110' is complete, as shown in FIG. 4B.

Similarly, the key mechanism 100' is not limited to having two first barricades 113 and two second barricades 114. Namely, the key mechanism 100' may have only a first barricade 113 and a second barricade 114, achieving the same effect as described above.

Third Embodiment

Elements corresponding to those in the first and second embodiments share the same reference numerals.

Figure 6A:
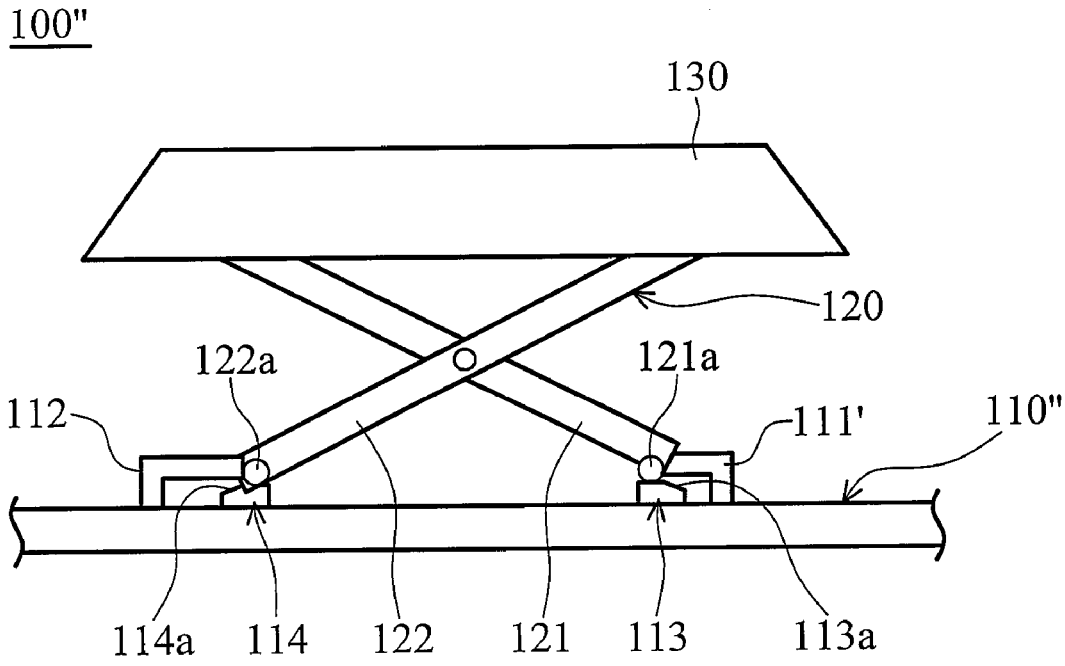
FIG. 6A is a schematic assembly view of a key mechanism of a third embodiment of the invention.
Figure 6B:
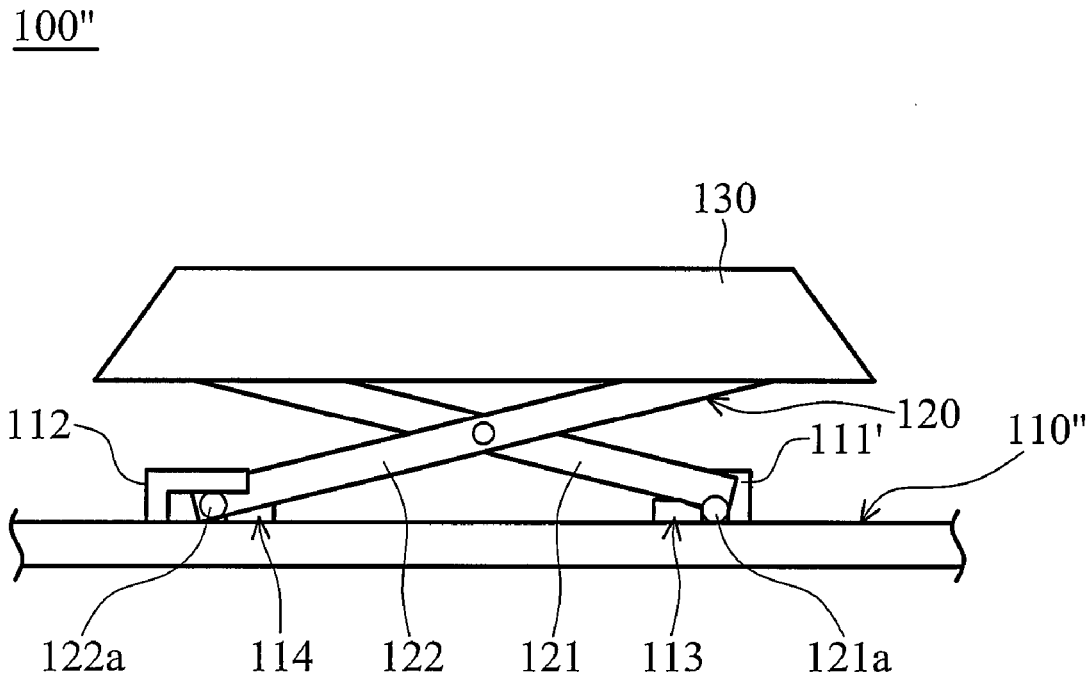
FIG. 6B is another schematic assembly view of the key mechanism of the third embodiment of the invention.

Referring to FIG. 6A and FIG. 6B, a key mechanism 100" comprises a base plate 110", a scissors linking assembly 120, and a keycap 130.

The keycap 130 is connected to the scissors linking assembly 120.

Figure 7A:
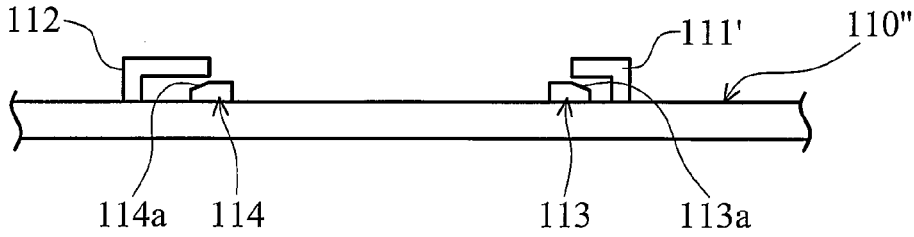
FIG. 7A is a schematic side view of a base plate of the key mechanism of the third embodiment of the invention.
Figure 7B:
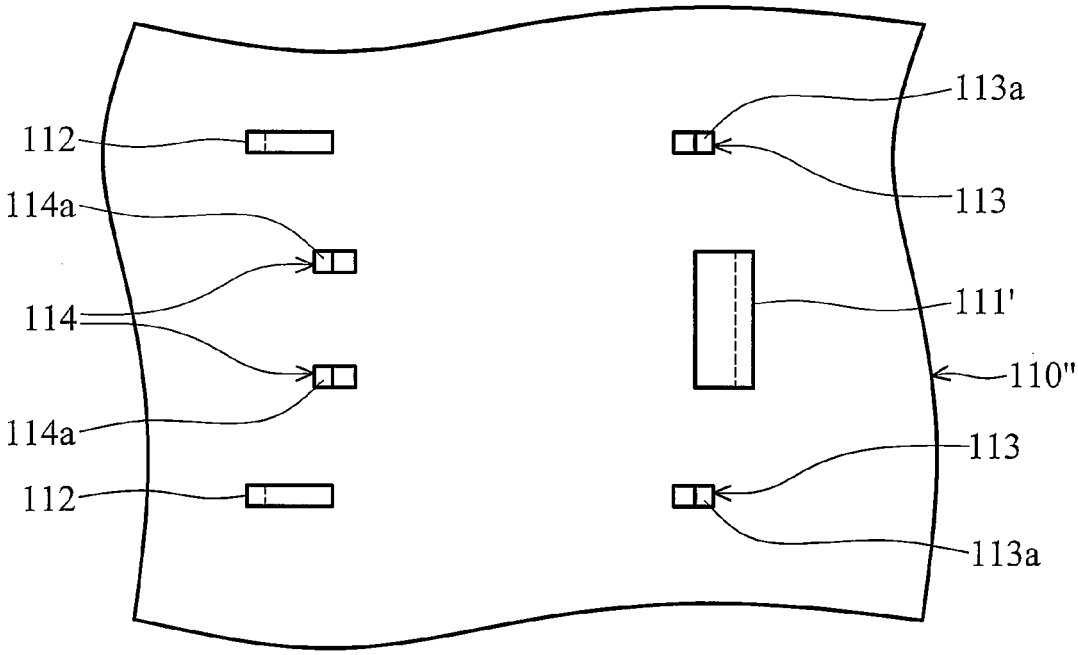
FIG. 7B is a schematic top view of the base plate of the key mechanism of the third embodiment of the invention.

Referring to FIG. 7A and FIG. 7B, the base plate 110" comprises a first guiding base 111', two second guiding bases 112, two first barricades 113, and two second barricades 114. The first guiding base 111' opposes the second guiding bases 112. The first barricades 113 oppose the second barricades 114. Each first barricade 113 comprises a first guiding slope 113*a*. Each second barricade 114 comprises a second guiding slope 114*a*. Moreover, the first guiding base 111' is disposed between the first barricades 113, and the second barricades 114 are disposed between the second guiding bases 112.

As shown in FIG. 6A and FIG. 6B, the scissors linking assembly 120 is connected to the base plate 110" and comprises a first linking member 121 and a second linking member 122. The first linking member 121 pivots to the second linking member 122 and comprises a first guiding pillar 121*a*. The second linking member 122 comprises a second guiding pillar 122*a*. The first guiding pillar 121*a* is disposed in the first guiding base 111' through the first guiding slopes 113*a* of the first barricades 113 and is rotatably abutted between the first guiding base 111' and the first barricades 113. The second guiding pillar 122*a* is disposed in the second guiding bases 112 through the second guiding slopes 114*a* of the second barricades 114 and is movably abutted between the second guiding bases 112 and the second barricades 114.

During assembly between the scissors linking assembly 120 and the base plate 110", as shown in FIG. 6A, the scissors linking assembly 120 is first placed on the base plate 110". Here, the first guiding pillar 121*a* of the first linking member 121 is placed on the first barricades 113 and abuts an outer edge of the first guiding base 111', and the second guiding pillar 122*a* of the second linking member 122 is placed on the second barricades 114 and abuts outer edges of the second guiding bases 112. Then, the scissors linking assembly 120 is directly pressed toward the base plate 110". Here, the first guiding pillar 121*a* is elastically deformed by pushing of the first guiding slopes 113*a* of the first barricades 113, and the second guiding pillar 122*a* is elastically deformed by pushing of the second guiding slopes 114*a* of the second barricades 114. When no longer pushed by the first barricades 113, the first guiding pillar 121*a* is positioned in the first guiding base 111'. Similarly, when no longer pushed by the second barricades 114, the second guiding pillar 122*a* is positioned in the second guiding bases 112. Namely, the first guiding pillar 121*a* is disposed in the first guiding base 111' by pushing of the first barricades 113, and the second guiding pillar 122*a* is disposed in the second guiding bases 112 by pushing of the second barricades 114. Accordingly, the assembly between the scissors linking assembly 120 and the base plate 110" is complete, as shown in FIG. 6B.

Similarly, the key mechanism 100" is not limited to having two first barricades 113 and two second barricades 114. Namely, the key mechanism 100" may have only a first barricade 113 and a second barricade 114, achieving the same effect as described above.

In conclusion, in the disclosed key mechanisms, only one step is required to combine the scissors linking assemblies with the base plates, thereby enhancing facilitation of the assembly thereof.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A key mechanism, comprising:

a base plate comprising at least one first guiding base, at least one second guiding base, at least one first barricade, and at least one second barricade, wherein the first guiding base opposes the second guiding base along a first line, and the first barricade opposes the second barricade along a second line parallel to and spaced apart from the first line, such that the first guiding base and the first barricade are offset along a plane of the base plate, and the second guiding base and second barricade are offset along the plane of the base plate, and wherein the first barricade comprises a first guiding slope;

a scissors linking assembly connected to the base plate and comprising a first linking member and a second linking member, wherein the first linking member pivots to the second linking member and comprises a first guiding pillar, the second linking member comprises a second guiding pillar, the first guiding pillar is disposed in the first guiding base through the first guiding slope of the first barricade to a first position in which it is abutted between the first guiding base and the first barricade, and the second guiding pillar is disposed in the second guiding base through the second barricade to a second position in which it is abutted between the second guiding base and the second barricade, wherein the first guiding pillar is rotatable in the first position; and a keycap connected to the scissors linking assembly.

2. The key mechanism as claimed in claim 1, wherein the second guiding pillar is movably abutted between the second guiding base and the second barricade when in the second position.

3. The key mechanism as claimed in claim 1, wherein the second barricade comprises a second guiding slope through which the second guiding pillar is disposed in the second guiding base.

4. The key mechanism as claimed in claim 1, wherein the first guiding pillar is disposed in the first guiding base by pushing of the first barricade.

5. The key mechanism as claimed in claim 1, wherein the second guiding pillar is disposed in the second guiding base by pushing of the second barricade.

6. The key mechanism as claimed in claim 1, wherein the first guiding base and the first barricade are on opposite sides of the first pillar when the first pillar is in the first position, and the second guiding base and the second barricade are on opposite sides of the second pillar when the second pillar is in the second position.

* * * * *